343-756 SR
2/20/79 XR 4,141,015

United States Patent [19]
Wong et al.

[11] 4,141,015
[45] Feb. 20, 1979

[54] CONICAL HORN ANTENNA HAVING A MODE GENERATOR

[75] Inventors: Mon N. Wong, Culver City; Charles J. Brandt, Hawthorne, both of Calif.

[73] Assignee: Hughes Aircraft Company, Culver City, Calif.

[21] Appl. No.: 723,869

[22] Filed: Sep. 16, 1976

[51] Int. Cl.[2] ..... H01Q 13/00
[52] U.S. Cl. ..... 343/786; 343/756; 343/783
[58] Field of Search ..... 343/786, 783, 756, 762, 343/732, 772

[56] References Cited

U.S. PATENT DOCUMENTS

| | | | |
|---|---|---|---|
| 3,413,642 | 11/1968 | Cook | 343/786 |
| 3,573,838 | 4/1971 | Ajioka | 343/783 |
| 3,624,655 | 11/1971 | Sato et al. | 343/786 |
| 3,906,508 | 9/1975 | Foldes | 343/786 |

*Primary Examiner*—Craig E. Church
*Assistant Examiner*—David K. Moore
*Attorney, Agent, or Firm*—R. A. Cardenas; John Holtrichter, Jr.; W. H. MacAllister

[57] ABSTRACT

A conical horn antenna is disclosed having dual dielectric bands mounted therein for improving the rotational symmetry or elipticity of the radiated beam as well as the efficiency. The first and second dielectric bands are coaxially mounted to each other and to the conical horn. The lengths of the bands are determined by the frequencies being propagated. A circularly polarized dominant wave such as $TE_{11}$ mode is applied to the antenna and excites a series of higher order waves such as the $TM_{11}$ mode. The circularly polarized dominant and the higher order modes are propagated toward the aperture where they are in phase and therefore add vectorially. The dual dielectric band acts as a slow wave structure and higher order waves which in turn provide an improved phasing between the dominant modes.

4 Claims, 5 Drawing Figures

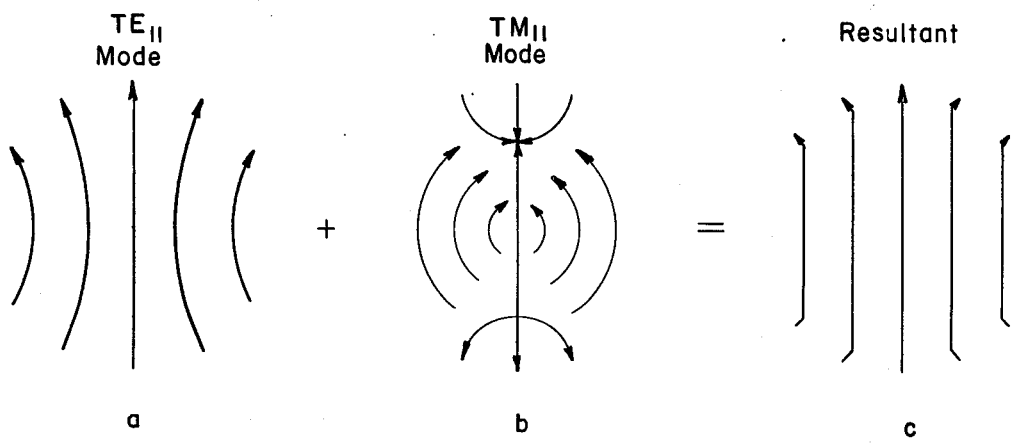
Fig. 2.
Fig. 1.
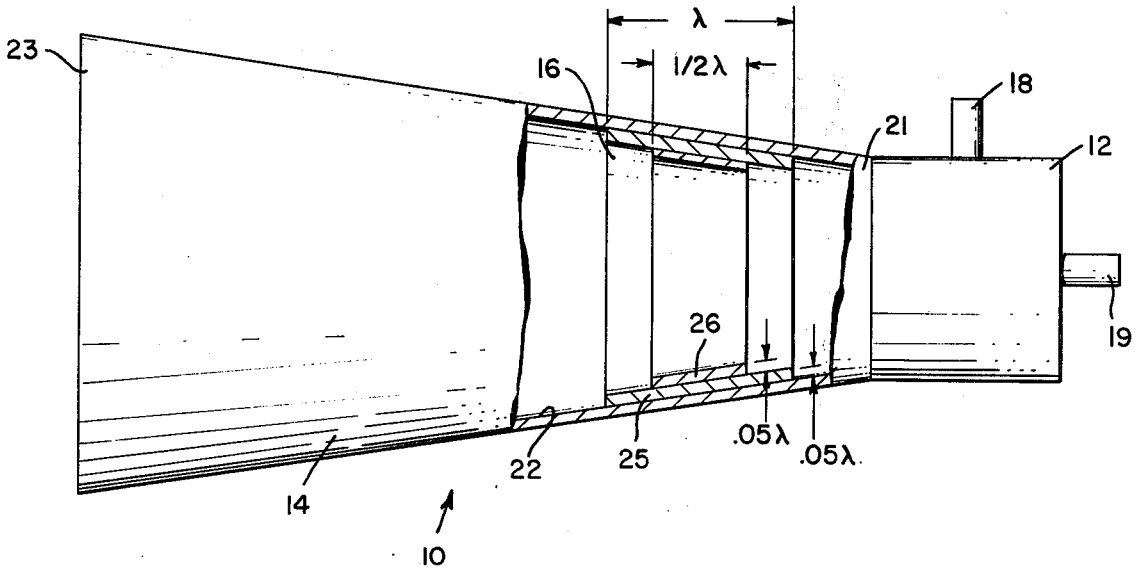

CONICAL HORN ANTENNA HAVING A MODE GENERATOR

FIELD OF THE INVENTION

The invention relates generally to an antenna and in particular the invention relates to conical horn antennas. A conical horn antenna for propagating first and second circular polarized waves. A first dielectric band is disposed therein.

DESCRIPTION OF THE PRIOR ART

Conical horn antennas are well known in the prior art, so too are the devices and techniques for exciting higher order modes in these antennas for improving their performance. One such method of exciting higher order modes and providing improved phase relationship between modes is to place reflector rods in a symmetrical arrangement lengthwise within the antenna horn. The reflector rods may have discs which are adjustable along the length of the rods for adjusting impedance of the horn. The length, diameter and positioning of the reflector rods within the horn are very critical since higher order modes are to be in phase with the dominant mode within the horn. Also, the horn must be longer in length if the reflector rod arrangement is utilized such a device generally results in poor polarization purity. A conical horn reflector utilizing reflector rods is disclosed in U.S. Pat. No. 3,573,838, Broadband Multimode Horn Antenna, issued to J. S. Ajioka on Apr. 4, 1971.

Another method of exciting higher order modes in an antenna and providing symmetrical waves is through the use of a conical horn having corrugations on the reflecting surface. Such a method requires a relatively large aperture. Generally, the corrugated horn reflector is machined from a solid metal stock which results in rather heavy antenna structure. Also, the cost of machining such a horn is very high due to the labor costs involved. Another limitation of the corrugated antenna is that the corrugations must be very accurately machined in order to properly excite the higher modes with proper amplitude and phase.

Fins have been employed in order to equalize the E and H fields at the aperture by providing phase compensation to the E field, in one mode but not in the other. Two sets of fins are generally placed in diametric opposition providing symmetry to the antenna horn. The size, number and location of the fins are critical for providing the required phase compensation. The fins however provide poor isolation between the orthogonal waves.

A method of providing a dual mode horn with rotational symmetry and low side lobes is described by Tashio Satoh in "Dielectric-Loaded Horn Antenna" in the IEEE Transactions on Antennas and Propagation of March 1972. A conical dielectric band is mounted within the conical reflector horn for exciting $TM_{11}$ modes. The dielectric band is a thin Teflon conic section mounted at a predetermined position within the horn. The arrangement of Satoh improves upon rotational symmetry and bandwidth of a similar horn without dielectric band as will be disclosed in greater detail below. A dielectric band such as the Satoh design has a limited bandwidth with respect to the present invention as will be illustrated.

OBJECTS AND SUMMARY OF THE INVENTION

Accordingly, it is an object of the present invention to provide a simple lightweight and broadband antenna structure.

It is another object of the present invention to provide an antenna structure providing improved isolation between two modes being propagated within the antenna.

It is another object of the invention to provide a horn antenna having improved impedance matching.

It is still a further object of the invention to provide a circularly polarized antenna horn having a reduced elipticity curve in response to a rotating linear source.

In accordance with the above objects a dual-dielectric band antenna includes a conical horn antenna for propagating circularly polarized waves. First and second concentric dielectric bands are disposed within the conical horn. The length of the first dielectric band is determined by the wavelength of the frequency being propagated. The length of the second dielectric band is approximately one half the length of the first dielectric band. The thickness of the first and second dielectric bands is determined by the wavelength of the propagated frequency. A dominant mode being injected into the conical horn antenna excites a series of higher order modes upon propagating past the dual dielectric bands. At the aperture of the antenna the dominant and higher order modes are approximately in phase and therefore add vectorially.

BRIEF DESCRIPTION OF THE DRAWINGS

FIG. 1 is a section view of a conical horn antenna illustrating a dual dielectric band.

FIG. 2 is a vector diagram of the dominant mode, higher order modes and the resultant mode of circular polarized waves propagating within the invention of FIG. 1.

DETAILED DESCRIPTION OF THE DRAWINGS

Figures 3A, 3B, 3C:
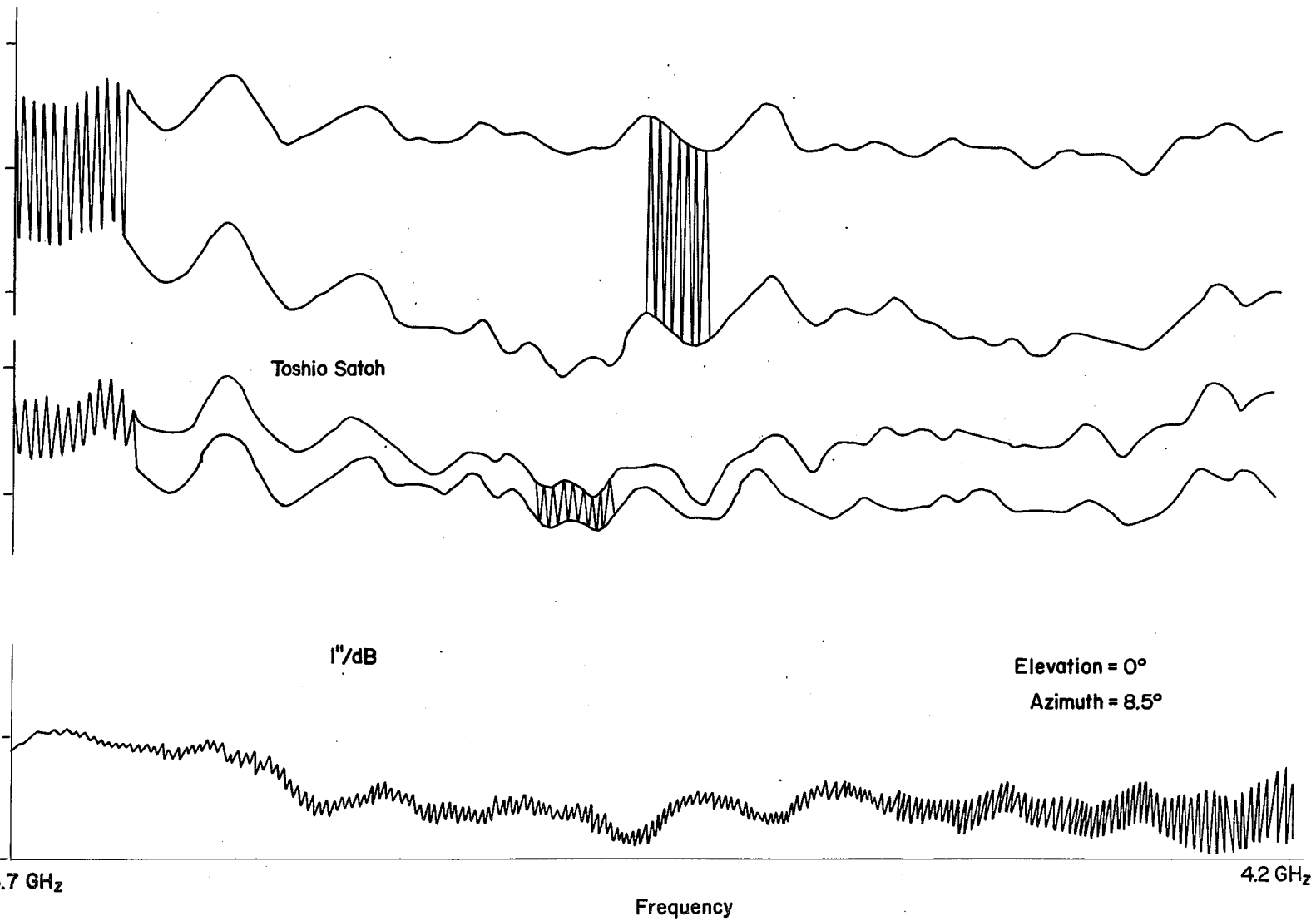
FIGS. 3*a–c* is a graph of axial ratios of prior art conic horn antennas and a conic horn antenna according to FIG. 1.

Referring now to FIG. 1, an antenna 10 according to the present invention includes a polarizer junction 12 connected to a conical horn antenna structure 14 having a dielectric mode generator 16 mounted therein. The junction 12 receives first and second linear orthogonal signals at first and second input ports 18 and 19, respectively. The polarizing junction 12 in turn generates first and second circularly polarized signals having first and second senses in response to the first and second input signals, respectively. For example, the first signal may be transformed into a clockwise, or right hand, circularly polarized vector while the second signal is transformed into a counterclockwise, or left hand circularly polarized vector. The polarizer junction 12 may have a quarter-wave polarizer plate disposed lengthwise along the cylindrical portion of the junction 12 between the input ports and the output port. The operation of a quarter-wave plate is well known and therefore will not be described in any greater detail. Also, any other method of imparting circular polarization to a linear signal may be employed.

The output port of the circular waveguide junction 12 is connected to the input port of the horn 14. The input port is also referred to as the throat section 21. The throat section 21, in a 4 GHz antenna, is 2.85 inches in diameter. A conical section 22 is in turn connected to the throat section 21. The conical section 22 may have a flare angle of 10.7 degrees and is 20.66 inches in length measured along the flared portion. The flare angle is determined by various factors including the center frequency of the passband. The aperture 23 of the horn 14 is 10.5 inches in diameter. The material of the conical horn 14 may be any suitable material and for space application a lightweight material such as glass impregnated fiberglass may be used. A reflective coating such as silver or aluminum is deposited on the inner surfaces of a fiberglass horn 14. The first and second circularly polarized waves propagate through the throat section 21 and into the conical section 22. As the waves pass through the mode generator 16, higher order modes are generated as will be explained below.

The mode generator or dual dielectric band 16 includes inner and outer dielectric bands, 25 and 26, respectively, being mounted within the conical section 22 of the horn 14. The outer band 25 is conical in shape and mounted to the interior reflecting surface of the antenna horn structure 14. The length of the outer dielectric band 25 is approximately one wavelength of a predetermined frequency being propagated by the antenna structure 14. The thickness of the dielectric band 25 is approximately 0.05 of a wavelength, for example. The material of the band 25 may be any dielectric material having a sufficiently large dielectric constant a thermoset cross-lined styrene copolymer. Rexolite, a product of American Enka Corporation is such a thermoset copolymer having a dielectric constant of 2.6 and has been successfully employed in several antenna structures for 4 and 6 GHz systems.

The inner dielectric band 26 is also conically shaped and has a length of ½ a wavelength of the predetermined center frequency, for example. The thickness of the band 26 is approximately 0.05 of a wavelength (the same as the outer band 25) and is made of the same dielectric material as the outer band 25. The inner dielectric band 26 is centered over the outer dielectric band 25 and mounted thereto. The inner and outer dielectric bands 25 and 26, respectively, may be made of one piece of material for convenience. The location of the mode generator 16 within the antenna horn structure 14 is generally empirically determined based upon the length of the horn 14, the center frequency being propagated therein and the flare angle. The positioning is such that the dominant modes and the higher modes of the waves being propagated within the structure 14 add vectorially at the aperture. It has been found that in an antenna structure 14 for propagating a 4 GHz signal, the mode generator 16 was placed approximately 0.42 of a wavelength at the frequency of interest from the throat section 21 of the horn 14.

Referring now to FIG. 2, the vector diagrams illustrate the modes propagating through the antenna structure 14. FIG. 2*a* illustrate two dominant mode waves, a clockwise circular polarized wave and a counterclockwise circular polarized wave, in the $Te_{11}$ mode. The dominant modes are injected into the throat section 21 of the horn antenna and propagate throughout the length of the horn 14 to the aperture 23. FIG. 2*b* depicts one of a series of higher order modes, the $TM_{11}$ mode, which is excited by the $TE_{11}$ mode as it passes through the mode generator 16. The figure illustrates both the right and left hand circular polarized higher order modes. As the dominant and higher order modes propagate out through conical section 22 from the mode generator 16, they rotate. At the aperture 23 the dominant and higher order modes are in phase and thus add vectorially as depicted by the resultant wave in FIG. 2*c*, thereby presenting a plane wave front.

In order to determine the performance of an antenna system, a first or source antenna radiates a linear signal to a second or receiving antenna. The source antenna and the receiving antenna are first bore-sighted to each other and then the radiating antenna is moved off-axis in either azimuth or elevation by 8.5 degrees to simulate the off-axis performance of a satellite antenna in outer space. For example, in certain communications satellites the earth subtends an angle of 17 degrees within the radiating pattern of the antenna. In order to determine the off-axis performance or ellipticity of the transmitting antenna system, a linear signal is applied to the source antenna and the horn antenna is rotated about its axis thus simulating a circular polarized wave. The receiving antenna is connecting to a plotter for graphing the maximum and minimum received energy in db as the linear signal scans the desired bandwidth. As the radiating source is rotated the ellipticity of the antenna will cause the linear signal received by the receiving antenna to vary between a maximum value and a minimum value. Thus the axial ratio is established. The performance of several conical horn antennas is depicted below.

Referring now to FIG. 3*a*, the axial ratio of a conical horn is illustrated. The ordinate axis corresponds to the frequency being scanned between 3.7 GHz and 4.2 GHz, while the abscissa is calibrated such that one inch equals 1 db. The graph of this figure represents a horn antenna without any mode generating device. It is noted that the axial ratio varies greatly across the bandwidth. The axial ratio is directly related to ellipticity and therefore a direct measure of performance. Thus, it may be seen from the figure that the ellipticity of an antenna without a mode generating device such as the present invention is 1.5 db.

FIG. 3*b* illustrates the axial ratio of a horn antenna having a single dielectric band mode generator according to Satoh. The dielectric band utilized for this test was made of Rexolite. It may be seen that the ellipticity is improved over the antenna having no mode generating device.

FIG. 3*c* illustrates the greatly improved axial ratio of a conical horn antenna utilizing the principles of the present invention. It is noted that the ellipticity of the antenna is greatly reduced which means the amplitude of the received signal is relatively constant notwithstanding the rotation of the radiating source. Thus, the ellipticity of an antenna according to the present invention is 0.7 db. The device will achieve better than −30 db isolation between first and second orthogonal input signals over the 12% bandwidth in addition to having an increased bandwidth. The 5% bandwidth has an isolation of −40 db. The input voltage standing wave ratio (VWSR) is bettern than 1.08 to 1.

Although the present invention has been shown and described with reference to particular embodiments, nevertheless, various changes and modifications obvious to one skilled in the art to which the invention pertains are deemed to be within the purview of the invention.

What is claimed is:

1. An improved mode generator device for use in a horn antenna for propagating a dominant mode wave having a wavelength λ, comprising:

an outer dielectric band being conically shaped and having a length of approximately one wavelength and a predetermined thickness, said outer dielectric band being contiguous with the inner circumference of a conical horn antenna; and an inner dielectric band being conically shaped and having a length of approximately half a wavelength and a predetermined thickness, said inner dielectric band being contiguous with said outer dielectric band, said inner and outer dielectric bands being for generating higher order mode electromagnetic waves in response to dominant mode circular polarized electromagnetic input waves and for causing said dominant mode and said higher order modes to be in phase at the aperture of said conical horn antenna.

2. The invention according to claim 1, comprising:

said outer dielectric band being λ in length; and said inner dielectric band being λ/2 in length, said inner dielectric band being centered over said outer dielectric band.

3. An improved conical horn antenna having a device for generating higher order mode waves having a wavelength λ, comprising:

input means for providing circular polarized waves having a dominant mode;

a conical horn antenna having an inner surface being coupled to said input means for propagating dominant and higher order mode waves;

a first dielectric band having an inner surface, a length of approximately one wavelength and constant thickness being mounted directly to said inner surface of said conical horn antenna; and a second dielectric band having a length of approximately half a wavelength and thickness being mounted directly to said inner surface of said first dielectric band, said first and second dielectric bands for generating higher order mode waves in response to a dominant mode wave, said first and second dielectric bands being disposed within said conical horn antenna such that said dominant mode and said higher order modes are in phase at said aperture thereby providing a polarized wave having improved ellipticity.

4. The invention according to claim 3, comprising:

said first dielectric band having a length λ; and said second dielectric band having a length λ/2 and being centered on said first dielectric band.

* * * * *